United States Patent [19]

Tom et al.

[11] 4,063,737

[45] Dec. 20, 1977

[54] GOLF CLUB

[76] Inventors: Leung Chong Tom, 12460 Breault St., Pierrefonds; Jun Kin Wong, 4070 Kent Ave., Montreal, both of Quebec, Canada

[21] Appl. No.: 695,245

[22] Filed: June 11, 1976

Related U.S. Application Data

[63] Continuation-in-part of Ser. No. 464,116, April 25, 1974, abandoned.

[30] Foreign Application Priority Data

Apr. 18, 1974 Canada ..... 197897

[51] Int. Cl.[2] ..... A63B 53/02

[52] U.S. Cl. ..... 273/174; 273/80.5; 273/80.8

[58] Field of Search ..... 273/77 R, 80.2–80.8, 273/167–175

[56] References Cited

U.S. PATENT DOCUMENTS

| | | | |
|---|---|---|---|
| D. 237,201 | 10/1975 | Mader | 273/174 X |
| 727,819 | 5/1903 | Mattern | 273/174 X |
| 863,728 | 8/1907 | Legh | 273/78 X |
| 1,139,985 | 5/1915 | Legh | 273/167 F X |
| 1,458,564 | 6/1923 | Weager et al. | 273/174 |
| 1,501,344 | 7/1924 | Hubbard | 273/80.2 |
| 1,517,476 | 12/1924 | Tyler | 273/174 X |
| 1,552,297 | 9/1925 | Harness | 273/173 |
| 1,674,136 | 6/1928 | Shidler | 273/171 |
| 1,946,208 | 2/1934 | Hampton | 273/174 X |
| 1,975,341 | 10/1934 | Young | 273/173 X |
| 2,004,968 | 6/1935 | Young | 273/174 |
| 2,203,893 | 6/1940 | Chapman | 273/174 X |
| 2,332,342 | 10/1943 | Reach | 273/174 X |
| 2,346,617 | 4/1944 | Schaffer | 273/173 X |
| 2,686,056 | 8/1954 | Oquist | 273/174 X |
| 2,891,138 | 6/1959 | Letters | 273/80.2 X |
| 3,212,783 | 10/1965 | Bradley et al. | 273/173 X |
| 3,305,235 | 2/1967 | Williams | 273/174 X |
| 3,640,534 | 2/1972 | Mills | 273/174 X |
| 3,661,388 | 5/1972 | Leslie | 273/80.2 |
| 3,759,517 | 9/1973 | Mills | 273/174 X |
| 3,985,363 | 10/1976 | Jepson | 273/173 |

FOREIGN PATENT DOCUMENTS

| | | | |
|---|---|---|---|
| 1,912 | 5/1931 | Australia | 273/174 |
| 456,505 | 5/1949 | Canada | 273/169 |
| 679,292 | 9/1952 | United Kingdom | 273/169 |
| 376,903 | 7/1932 | United Kingdom | 273/167 R |

*Primary Examiner*—Richard J. Apley
*Attorney, Agent, or Firm*—Robert J. Schaap; Ian Fincham

[57] ABSTRACT

This invention relates to a "wood" golf club having a shaft and a club head wherein the club head has at least a portion of a metallic material, the portion including at least 30% of the face area of the club head. The portion also includes an integral sole and the portion is connected directly to the shaft.

5 Claims, 5 Drawing Figures

GOLF CLUB

This application is a continuation-in-part of U.S. Pat. Application Ser. No. 464,116, filed Apr. 25, 1974 now abandoned.

This invention relates to golf clubs and in particular, to "wood" golf club heads.

The game of golf is an ancient one which originated in Scotland and which has come to enjoy enormous popularity in many countries. The original equipment used in the playing of golf was satisfactory for the time however, with the increased popularity in the game, more advanced technology has been applied to the manufacture of the equipment used in the game. Thus, for example, new types of golf balls were developed which gave increased distance due to their superior coefficient of restitution. Even more recently, attention has been paid to the golf clubs themselves and to ways of improving them so as to give increased distance. Thus, improved designs for the "irons" have been developed and are now widely accepted.

Traditionally, golf clubs are categorized as being either woods or irons. The irons have been used for play off the fairway and are felt to give increased accuracy compared to the woods. The woods, on the other hand, are generally employed when a premium is placed on distance. Generally, this invention is directed to the class of golf clubs generally characterized as "woods".

In the manufacture of traditional golf clubs, and reference herein is made to "wood" golf clubs, the club head is usually manufactured of a suitable hard wood, such as persimmon. The club head also traditionally incorporates a "sole" or "sole plate" which is usually of a metallic material to afford protection to the club on at least a portion of the bottom surface thereof, and at the same time, depending upon the club itself, the sole plate will add weight to the club head. The sole plate is usually held to the wood portion by means of screws or the like retaining means. Furthermore, the traditional wood golf club may incorporate a plastic insert in the face of the club usually centered at the "hitting" area of the face.

The limitations on a wood golf club according to the rules of the game state that a wood club is one with a head relatively broad from face to back and the length shall be greater than the breadth. Further limitations state that the club face shall not embody any degree of concavity on the hitting surface and may only have certain specified markings on the face.

A traditional wood golf club head, due to its relatively uniform composition, has a center of gravity situated in the middle of the length of the head and closer to the front of the club than the back. If the ball is not contacted by a point on the face head on line with the center of gravity, the club head will tend to turn and a misdirected shot will occur. In the art, this point or place where maximum distance will occur is known as the "sweet spot". In traditional golf club heads, and especially in wood golf club heads, this sweet spot encompasses a very small area of the face of the club.

The traditional wood golf club presents problems for the amateur or less skilled golfer. It has been estimated that less than 20% of the shots hit by the "average" golfer are shots wherein the ball is contacted at the "sweet spot" of the golf club head. More often than not, the ball is contacted at a spot on the face of the club head slightly spaced apart from the sweet spot. Moreover, it has been found that a considerable amount of the energy is absorbed by the wood material of the club head resulting in less distance on the shot.

It has been proposed in the prior art to incorporate a face element of a different material, the different material having a high modulus of elasticity to minimize the energy loss due to the compression of the wood material on the face of the club head. However, even when the face is of a high modulus of elasticity metallic or plastic material, it has been found that a substantial energy loss still occurs. This is believed to be due to the fact that though the insert has a high modulus of elasticity, the energy is still lost in being transmitted back to the wood portion of the club.

Various proposals have been advanced in the art to improve wood golf clubs and for example, reference may be had to U.S. Pat. No. 1,552,297 to Harness which discloses a two-component golf club comprised of an aluminum casing about a filler material. The club face incorporates an insert similar to conventional wood golf clubs. A more recent proposal is shown in U.S. Pat. No. 3,212,783 to Bradley et al. The golf club taught therein is also the "two-component" type of metallic and plastic materials. This reference teaches the use of inserts with substantial weight placed behind the impact point of the striking face plate.

It is an object of the present invention to provide a golf club of the wood type which is capable of attaining greater distance for the same force when compared to traditional wood golf clubs.

It is a further object of the present invention to provide a golf club of the wood type having a large sweet spot resulting in greater shot accuracy compared to the traditional type of wood golf club.

It is a still further object of the present invention to provide a wood golf club formed of two different materials, which golf club is strong and durable while being easily assembled.

In greater detail, a golf club of the present invention comprises a shaft, a hosel, and a club head, the club head being of two different materials arranged in a specified manner to achieve the objects of the invention set forth above.

The shaft employed in the golf club of the present invention may be of any type conventional in the art. Thus, it may be formed of materials such as aluminum, steel, graphite, etc. and is generally of a "tapered" construction having a suitable hand grip thereon.

As aforementioned, the club head is formed of two different materials; a first portion of the club head is of a metallic material having a high modulus of elasticity, the metallic portion forming the sole plate of the club head and at least a portion of the face area of the club head. The portion of the face area formed by the metallic portion is at least 30% and preferably, ranges between 50% to 100% of the total area. The metallic portion extends the complete width of the face area.

The metal forming the metallic portion may be any which is suitable and well known to those skilled in the art. Preferably, metals such as aluminum, stainless steel, and alloys thereof will be utilized due to the suitable characteristics of the metals and their cost. However, other metallic materials may be employed provided that these materials have a sufficiently high modulus of elasticity.

The first portion of metallic material has its weight distributed over strategic areas of the golf club head to concentrate the metal weight generally spaced apart from the hitting area of the club face. As may be appreciated, there exists only one center of gravity for an object. However, there also exists a range about this point of center of gravity wherein the difference is relatively non-existent. Thus, if one were to have a uniform elongated bar of material, the center of gravity would be located equidistant from the ends thereof. If the object were supported at its center of gravity, a small force applied perpendicular to the axis at any point away from the center of gravity would cause a rotation of the bar. However, if one were to have two equal masses connected by a rod of negligible weight, the center of gravity would remain equidistant of the weights. In this case, a movement perpendicular to the bar would not cause as great a rotational movement to occur as would in the case of the uniform bar without weights.

Thus, the weight distribution of the metallic portion may be engineered so as to achieve a maximum radius of gyration resulting in a much larger sweet spot. In a preferred embodiment of the invention, it is preferred that a portion of the mass of metallic material be concentrated at the heel and toe portions of the club head and around the peripheral edge of the sole plate. To this end, the sole plate preferably has such a peripheral ridge which has a thickness greater than the thickness of the inner portion of the sole plate; this ridge of increased thickness would, nevertheless, constitute a minor portion of the total height of the golf club and preferably, would be in the range of between 3% and 5% of the total height of the club head.

As aforementioned, the sole plate is integral with the face of the club head and has a peripheral ridge running thereabout. In the preferred embodiment, there are presented a pair of upwardly directed members. The first of these members forms an attachment post over which the hollow shaft of the golf club fits. Preferably, this attachment member or post has a shoulder formed thereon against which the end of the hollow shaft abuts. The second of the upwardly presented members forms a guiding means for the guiding of the second portion of the club head into its desired relationship with the metallic portion as will be discussed in greater detail hereinafter. Furthermore, these members constitute a significant portion of heel and toe weight distribution mentioned above.

The second portion of the club head is formed of a non-metallic material having a density less than that of the first material. Preferably, it does not contribute substantially to the total weight of the club head; materials such as wood, plastics, etc. may be employed.

The second lighter portion includes a neck which has an aperture extending therethrough in line with the post for securing the shaft. This aperture is preferably sized to receive a hosel as will be discussed in greater detail hereinafter.

The hosel comprises a one-piece metallic member having a first end of a cylindrical configuration with a bore extending therethrough and the other end presenting an abutment shoulder adapted to abut against one end of the neck of the second portion of the club head and tapering inwardly therefrom.

In the manufacture of the club head, preferably the first metallic portion of the club head is manufactured by the well known investment casting process. In this process, disposable wax patterns are formed, the patterns are then dipped in refractory slurries, the disposable material is melted out, and the molten metal is poured into the cavity thus formed. The investment casting process is noted for its precision and products, which, in turn, allows better production control such as swing weight, total weight, loft and lie, etc. Also, such a precision technique will ensure that each club will be exactly the same as any other in the series. Even further, finishing requirements are minimal when compared with the old golf club manufacturing technique of hand adjusting each specific area such as loft and lie, etc.

Following manufacture of the first metallic portion, the second portion is then secured to the first portion by adhesive means. The second portion is sized so as to leave a cavity within the club head substantially behind the face of the same. Subsequently, the hosel is placed on the shaft and the shaft and hosel inserted in the aperture of the neck portion of the second portion of the club head. All portions may then be adhesively secured together.

Having thus generally described the invention, reference will be made to the accompanying drawings illustrating an embodiment thereof, in which.

Figure 1:
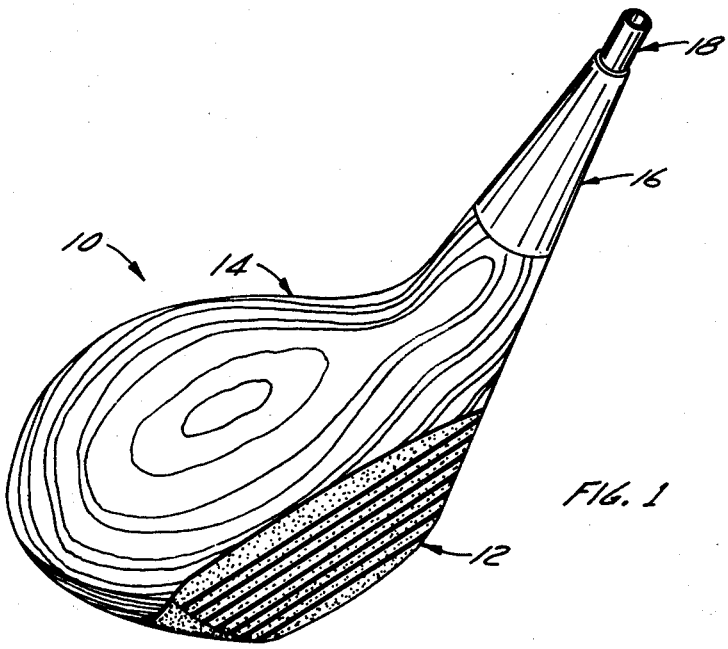
FIG. 1 is a perspective view of a golf club head according to the present invention.
Figure 2:
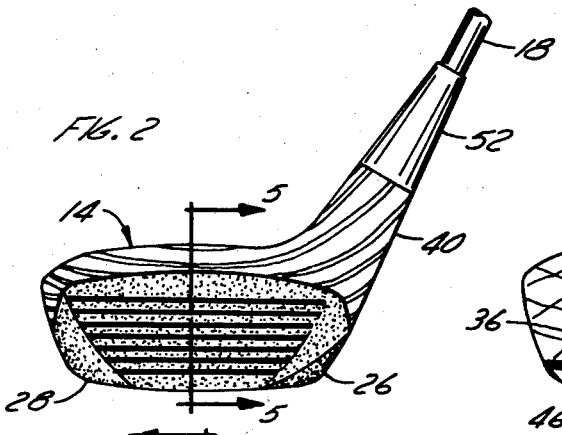
FIG. 2 is a front view of the club head of FIG. 1.

Referring to the drawings in greater detail, FIG. 1 is a perspective view of a golf club head constructed according to the present invention. As shown, the club head 10 comprises a first portion 12, a second portion 14, a hosel 16, and a shaft 18.

Portion 12 is formed of a metallic material such as aluminum or stainless steel and forms a club head face 20 with an integral sole 22. Face 20 may have conventional longitudinally extending parallel grooves. About the periphery of sole plate 22 there is provided a ridge 24.

In the drawings, face 20 is sloped with respect to sole plate 22 as is conventional and the degree of slope determines the loft of the club. Face 20 may be of a thickness calculated to minimize energy loss due to energy being absorbed by the club due to compression of the material.

Portion 12 forms a heel 26 and a toe 28 of the club head. Preferably, these heel and toe areas provide a substantial portion of the weight of the club head so as to enlarge the sweet spot of the golf club. Even further, the provision of peripheral ridge 24 about the periphery of sole plate 22 aids in enlarging the sweet spot and in a typical embodiment, sole plate 22 may have a thickness throughout the center portion of approximately one-sixteenth of an inch while the ridge would have a height in the order of 3 times this dimension.

Figure 4:
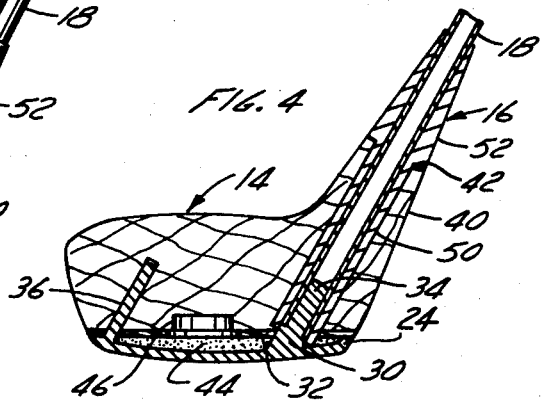
FIG. 4 is a sectional view along the line 4—4 of FIG. 3.
Figure 3:
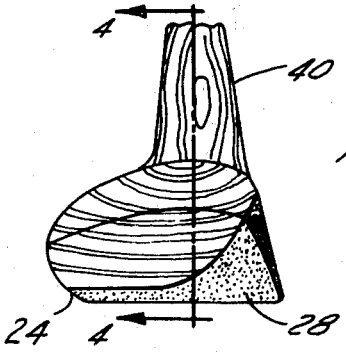
FIG. 3 is an end view of the golf club head of FIG. 1.

Located interiorly of the peripheral ridge 24 and integral with sole plate 22 is an attachment post generally designated by reference numeral 30. As may be seen from FIG. 4, attachment post 30 has a first cylindrical portion which forms a shoulder 32; attachment post 30 continues on in a cylindrical extension 34.

A further cylindrical member 36 is provided proximate to the peripheral ridge 24 and which member functions as a guiding means in the assembly of the club head.

Figure 5:
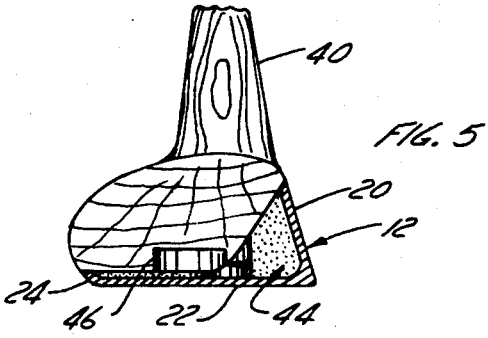
FIG. 5 is a sectional view along the line 5—5 of FIG. 2.

The second portion 14 of the club head is formed of a non-metallic material having a density substantially less than the density of the metallic portion and overall, forms a minor portion of the total weight of the club head. Typically, portion 14 may be formed of various woods and/or plastics. The shape of portion 14 is that of a conventional club head and includes a neck portion 40 having a shoulder 42 for reasons to be discussed hereinafter. As will be noted from FIG. 5, portion 14 is shaped so as to provide a cavity 44 between face plate 20 and portion 14. Cavity 44 extends rearwardly due to peripheral ridge 24. A further cavity, depending on the total weight of the club head, may be provided in portion 14 as is designated by reference numeral 46.

A hosel 16 is provided and which hosel has a first hollow cylindrical portion 50 integral with a frustoconical portion 52.

In assembly of the club head of the present invention, adhesive may be applied to guiding post 36, guiding post 34, ridge 24 and at the top of face plate 20. Portion 14 may then be secured to metallic portion 12. Subsequently, hosel 16 is placed on shaft 18; shaft 18 is inserted so as to slidably fit on portion 34 of attaching post 30. It will be noted that the end of shaft 18 seats on shoulder 32. Subsequently, hosel 16 is slid into place and fits within an aperture in neck 40 of portion 14 and seats itself on shoulder 42.

Preferably, metallic portion 12 is precision cast by the investment casting process to insure proper weight distribution and a minimization of finishing operations. The golf club will then have a larger sweet spot compared to the conventional type of wood golf club and the metallic face will minimize energy loss due to compression of the club material.

The securement of the shaft over the attachment post provides a secure fit and permits easy assembly. Furthermore, the arrangement is such so as to minimize breakage in the neck area of the club which is a frequent problem with prior art golf clubs. The club head can be reproduced with a high degree of precision which cannot always be done with wooden golf clubs due to the plurality of compound curves employed and the difficulty of establishing reference points for measurements. The investment casting process and the use of the attachment post and the guiding post overcome these problems.

It will be understood that various changes and modifications may be made to the above-described embodiment without departing from the spirit and scope of the invention.

We claim:

1. A golf club having a high radius of gyration comprising a hollow shaft, a hosel, and a club head;

said club head comprising first and second portions, said first portion being of a metallic material having a high modulus of elasticity, said first portion forming an integral sole plate and between 30 to 100% of the face area of the club head, said sole plate covering the complete bottom surface of the club head, said sole plate having a first upwardly directed integral member forming an attachment post over which said hollow shaft snugly fits, and a second upwardly directed integral member forming a guiding post in assembly of the club head, said sole plate including a peripherally extending ridge having a height greater than the thickness of the center of the sole plate and being a minor portion of the total height of the club head, said second portion of said club head being of a nonmetallic material having a density substantially less than the density of said first portion such that said second portion forms a minor portion of the weight of the club head, said second portion being secured to said first portion along the peripherally extending ridge and along said guiding post, said second portion being spaced from said first portion in the area of the face plate to form a cavity therebetween, said second portion having an aperture extending through a neck portion thereof, said hosel being adapted to snugly fit within said aperture over said shaft and extend to the sole plate, said first portion and second portion of said club being located with respect to each other so the relative weights and distributions of the first and second portions create a high radius of gyration.

2. The golf club of claim 1 wherein said first portion is selected from the group consisting of aluminum and stainless steel.

3. The golf club of claim 1 wherein said second portion is selected from the group consisting of wood and plastic materials.

4. The golf club of claim 1 wherein said first portion comprises about 30to about 75% of the face area of the club head.

5. The golf club of claim 1 wherein said shaft is adhesively secured to said attachment post.

* * * * *